US011646002B2

(12) United States Patent
Paige

(10) Patent No.: US 11,646,002 B2
(45) Date of Patent: May 9, 2023

(54) CAPO FOR USE WITH A STRINGED MUSICAL INSTRUMENT, AND METHOD OF USING SAME

(71) Applicant: Bryan Paige, Jonesville, MI (US)

(72) Inventor: Bryan Paige, Jonesville, MI (US)

( * ) Notice: Subject to any disclaimer, the term of this patent is extended or adjusted under 35 U.S.C. 154(b) by 0 days.

(21) Appl. No.: 17/585,784

(22) Filed: Jan. 27, 2022

(65) Prior Publication Data

US 2022/0246116 A1 Aug. 4, 2022

Related U.S. Application Data

(60) Provisional application No. 63/144,011, filed on Feb. 1, 2021.

(51) Int. Cl.
*G10D 3/053* (2020.01)

(52) U.S. Cl.
CPC ..... *G10D 3/053* (2020.02)

(58) Field of Classification Search
CPC ..... G10D 3/053
See application file for complete search history.

(56) References Cited

U.S. PATENT DOCUMENTS 1,007,960 A 11/1911 Moore
3,647,930 A * 3/1972 Wowries ..... G10D 3/053 84/452 P
4,104,947 A 8/1978 Oster
4,143,576 A * 3/1979 Nichols ..... G10D 3/053 984/114
D257,988 S 1/1981 Nakamoto
4,250,790 A 2/1981 Shubb et al.
4,334,457 A * 6/1982 Spoonts, III ..... G10D 3/053 984/114
D281,508 S 11/1985 McKinney, III
5,081,894 A * 1/1992 Paige ..... G10D 3/053 84/318
5,623,110 A * 4/1997 Hoglund ..... G10D 3/053 84/318
6,569,040 B2 5/2003 Bradstock
7,557,285 B2 * 7/2009 Ward ..... G10D 3/053 84/422.1
7,753,990 B2 7/2010 Freeman et al.
(Continued)

*Primary Examiner* — Robert W Horn
(74) *Attorney, Agent, or Firm* — Carrier Shende & Associates, P.C.; Joseph P. Carrier; Fulchand P. Shende

(57) ABSTRACT

A capo for a musical instrument with a neck and a plurality of parallel strings disposed above the neck. The capo includes a U-shaped yoke having first and second branches, and a clamping bar assembly pivotally attached to one of the yoke branches. The clamping bar assembly includes a main bar body and a plurality of separate string clamp members, which are operatively attached to the main bar body and formed of a substantially rigid plastic material. The clamping bar assembly also includes one or more flexibly resilient cushion members provided between the string clamp members and the main bar body. The main bar body may have sockets formed therein which receive individual cushion members and portions of the string clamp members. Alternatively, the string clamp members may share a single elongated cushion member, and may have passages formed therethrough allowing for slidable mounting on a solid main bar body.

18 Claims, 17 Drawing Sheets

(56) References Cited

U.S. PATENT DOCUMENTS

| | | | | |
|---|---|---|---|---|
| 7,973,227 | B2 * | 7/2011 | Paige | G10D 3/053 84/318 |
| 8,642,863 | B2 * | 2/2014 | Del Priore | G10D 3/053 84/318 |
| 9,257,102 | B2 * | 2/2016 | Ryan | G10D 3/053 |
| 9,424,817 | B2 * | 8/2016 | Ryan | G10D 3/053 |
| 9,953,622 | B2 * | 4/2018 | Campling | G10D 3/053 |
| 10,008,186 | B2 * | 6/2018 | Kinney | G10D 3/053 |
| 10,147,404 | B2 * | 12/2018 | Campling | G10D 3/053 |
| 10,810,975 | B2 | 10/2020 | Paige | |
| 11,037,534 | B2 * | 6/2021 | Bradley | G10D 3/053 |
| 11,069,329 | B2 * | 7/2021 | Eckerström | G10D 3/053 |
| 11,138,958 | B2 | 10/2021 | Paige | |
| 2022/0246116 | A1 * | 8/2022 | Paige | G10D 3/053 |

* cited by examiner

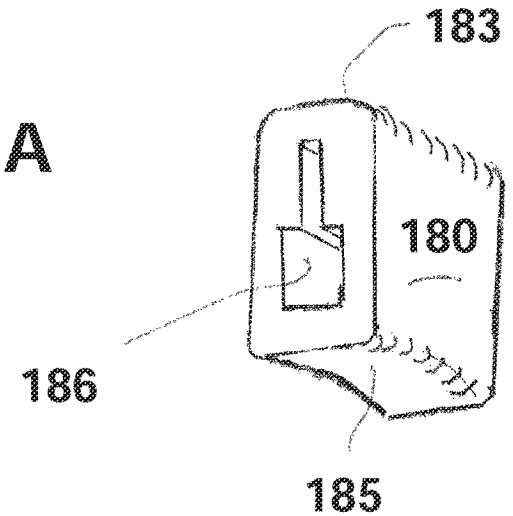
FIG. 11A
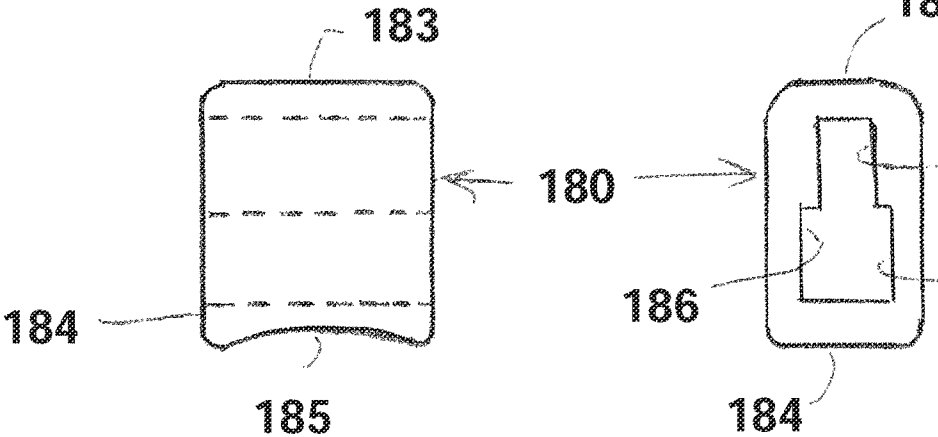
FIG. 11B
FIG. 11C

CAPO FOR USE WITH A STRINGED MUSICAL INSTRUMENT, AND METHOD OF USING SAME

CROSS-REFERENCE TO RELATED APPLICATIONS

This application is based upon, and claims priority from U.S. Provisional Patent Application No. 63/144,011, filed Feb. 1, 2021. The entire contents of the referenced priority application is incorporated by reference herein.

BACKGROUND OF THE INVENTION

1. Field of the Invention

The present invention relates to a capo for use with a stringed musical instrument having a neck portion including a fretboard, and a plurality of strings extending parallel to one another adjacent the fretboard, and to a method of using the capo.

2. Description of the Background Art

A number of different capos are known for use with stringed musical instruments, particularly guitars, banjos and the like, which have a neck portion including a fretboard on which the strings are played. The capo is a clamping device which fits on the instrument neck, that interacts with the underside of the neck below the fretboard, and which is used to selectively clamp the strings against the fretboard so as to alter the effective length of vibration of the strings, and thereby to selectively raise the respective tones produced by the instrument.

The capo allows for selective alteration of the tonality of the strings without affecting the original tuning of the instrument. Thus, by placing the capo at a pre-selected location on the fretboard, a musician can play his/her instrument and produce a desired sound quality, since the pitch produced by the strings with the capo attached is different from the pitch produced by the stings with the capo absent. This allows a musician to temporarily change the effective key in which the instrument is playing.

A number of different capos are known and commercially available.

U.S. Pat. No. 608,278 to Benson, dated Aug. 2, 1898, discloses a capo having a generally U-shaped main body, a clamping bar connected to the upper portion of the main body for transversely contacting the fretboard strings, a foot for pressing against the underside of the fretboard, a screw operated clamping mechanism and a guide finger interconnected with the foot and the lower portion of the main body for keeping the foot from turning when the screw of the screw operated clamping mechanism is rotated to effect clamping of the clamping bar onto the strings.

U.S. Pat. No. 656,904 to Pletcher, dated Aug. 28, 1900, discloses a capo having a clamping bar for pressing transversely against the strings, a clasp member pivotally connected to the clamping bar, an arm member connected to one end of the clamping bar, and a spring steel clip pivotally connected with the arm and which is structured to selectively engage the clasp member.

U.S. Pat. No. 775,399 to Halladay, dated Nov. 22, 1904, discloses a capo having a clamping bar for transversely engaging the strings, an arm connected to the clamping bar, and a screw actuated lever clamp pivotally interconnected with the arm.

U.S. Pat. No. 1,007,960 to Moore, dated Nov. 7, 1911, discloses a capo having a clamping bar for transversely contacting the strings, a rod pivotally connected at either side of the clamping bar, and a screw operated foot pivotally connected to the free ends of the rods.

U.S. Pat. No. 4,104,947 to Oster, dated Aug. 8, 1978, discloses a capo having a U-shaped member of which the upper portion thereof serves as a clamping bar for transversely engaging the strings, two off-set resilient string engaging members, a screw operated clamping mechanism connected with the lower portion of the U-shaped member and a foot interconnected with the clamping mechanism and a central portion of the U-shaped member.

U.S. Pat. No. 4,250,790 to Shubb et al, dated Feb. 17, 1981, discloses a capo having a clamping bar with a resilient material for transversely contacting the strings, an arm connected to the clamping bar, a curved jaw pivotally connected to the arm for contacting the underside of the fretboard, a lever pivotally connected to the arm in spaced relation with respect to the curved jaw, and a screw mechanism interconnected with the lever.

U.S. Design Pat. No. D257,988 to Nakamoto, dated Jan. 20, 1981, discloses an ornamental design for a capo showing a yoke having a pivotally connected clamping bar for transversely contacting the strings, a releasable clasp mechanism for holding the clamping bar in fixed relation to the yoke, and a screw operated clamp mechanism which includes a foot for contacting the underside of the fretboard and guide rods for preventing the foot from rotating when the screw is rotated.

U.S. Design Pat. No. D281,508 to McKinney, III, dated Nov. 26, 1988, discloses an ornamental design for a capo showing a yoke having a pivotally connected clamping bar for transversely contacting the strings, a releasable clasp mechanism for holding the clamping bar in fixed relation to the yoke, and a screw operated clamp mechanism which includes a foot for contacting the underside of the fretboard and a guide member for preventing the foot from rotating when the screw is rotated.

U.S. Design Patent D446,540 issued Aug. 14, 2001 to Elliott discloses another ornamental capo design.

U.S. Pat. No. 5,081,894 to Paige, issued Jan. 21, 1992, discloses a capo including a semi-circular yoke, a clamping bar pivotally connected to a first fork of the yoke and releasably interlocked at the second end to a second fork of the yoke via intermeshing of opposing slots, a clasp mechanism for releasably locking onto an end of the clamping bar, a screw-operated foot connected with the yoke, and dual guide clamping bars connected at either side of the foot which movably engage slots in the yoke. The capo of this reference engages the strings uniformly and simultaneously as the screw is tightened.

U.S. Pat. No. 7,973,227 to Paige discloses another capo design which includes a quick coarse adjustment feature and a fine adjustment feature which permits quick installation of the capo on an instrument. Other capo patents to Paige include 10,810,975 and 11,138,958.

While the foregoing examples of capos and other tools are usable for their intended purposes, a need still exists in the art for an improved capo. In particular, there is a need for an improved capo, and method of using same, which includes a clamping bar provided with a plurality of independent string-contacting members.

A need also exists for a capo and method of using the capo including a clamping bar assembly having a main bar body and a plurality of separate string clamp members formed of a durable, substantially rigid plastic material, where the string clamp members are operatively attached to the main bar body and at least one flexibly resilient cushion member is provided between the string-contacting members and a main bar body.

SUMMARY OF THE INVENTION

Accordingly, it is an object of the present invention to provide an improved capo which includes a clamping bar having a separate, self-adjusting string-contacting member for each string.

A capo according to a first illustrative embodiment of the invention includes a yoke having a central support member, a string-contacting clamping bar which is pivotally attached to a branch of the yoke, a plurality of string-contacting members attached to the clamping bar, and at least one resilient cushion member disposed between the clamping bar and one or more of the string-contacting members.

The capo according to the first illustrative embodiment of the invention, also includes a substantially Y-shaped saddle member, including a stem which slidably fits through a second hollow bore of the central support member, a seat portion which is configured to contact a neck of an instrument, and an adjustment member for positioning the saddle member in the yoke.

The yoke according to the first illustrative embodiment is substantially U-shaped, and includes a central support member, with a first hollow bore formed therein defining a first axis, and having a back wall therein at the innermost portion of the first hollow bore. The central support member also has a second hollow bore formed therethrough, defining a second axis which is substantially perpendicular to the first axis, where the second hollow bore intersects the first hollow bore.

The yoke according to the first illustrative embodiment also includes a first yoke branch extending outwardly on one side of the central support member, and a second yoke branch extending outwardly on the other side of the central support member. The first yoke branch has a first yoke branch end with a first opening formed therein to receive a pivot member.

The capo according to the first illustrative embodiment also includes a clamping bar pivotally attached to the yoke, the clamping bar including a main bar body having a first end and a second end, the first end of the clamping bar being pivotally connected to the first branch end of the yoke, and the second end of the clamping bar is operatively engagable with the nesting notch of the yoke's second branch.

The capo according to the first illustrative embodiment also includes a latch structure pivotally attached to the second branch end of the yoke for releasably engaging the second end of the clamping bar to temporarily and releasably lock the second end of the clamping bar to the second branch end of the yoke.

The clamping bar assembly according to the first embodiment of the invention also includes a plurality of individual string clamp members, each of the string clamp members being formed separately from and movable independently of any adjacent string clamp members. Each of the string clamp members is configured to be slidably movable in relation to the main bar body, and each of the string-contacting members has a hollow passage formed therethrough. Each of the string clamp members has a cushion-contacting portion and a string-contacting portion spaced away from the cushion-contacting portion.

The capo according to the first embodiment of the invention also includes at least one resilient cushion member disposed between the main bar body and the cushion-contacting portion of at least one of the string clamp members. A single cushion member may extend the length of the main bar body and contact multiple string clamp members, or alternatively, each of the string clamp members may be provided with its own corresponding cushion member.

In the first illustrative embodiment of the invention, the main bar body of the capo's clamping bar has a plurality of sockets formed therein extending substantially parallel to one another, each of the sockets having a floor and being configured to receive a string clamping member. The main bar body further has a plurality of hollow bores formed therethrough, each of the bores intersecting a respective one of the sockets at a substantially 90 degree angle.

Also in the first illustrative embodiment of the invention, the capo's clamping bar includes a plurality of resilient cushion members in a number corresponding to the plurality of sockets, where each of the sockets receives a cushion member therein proximate the socket floor.

Further in the first illustrative embodiment of the invention, the capo's clamping bar further includes a plurality of string clamp inserts, each of the inserts having a cushion-contacting end and a string-contacting end opposite the cushion-contacting end. Each of these string clamp inserts is configured to fit slidably inside a respective one of the sockets of the main bar body, and each of the string clamp inserts has a central slot formed therethrough and configured to receive a cylindrical shaft of a fastener.

Still further in the first illustrative embodiment of the invention, the capo's clamping bar further includes a plurality of fasteners, with each of the fasteners having a cylindrical shaft which passes through one of the hollow bores of the main bar body and through the slot of a corresponding one of the inserts to slidably retain the corresponding insert in a respective one of the sockets of the main bar body.

In a second illustrative embodiment of the invention, the main bar body of the capo's clamping bar is a metal bar having a rectangular cross-section.

Further in the second illustrative embodiment of the invention, the capo further includes a plurality of separate string clamping members, each having a cushion-contacting portion and a string-contacting portion spaced away from the cushion-contacting portion. Each of the string-contacting portions has an arcuate string-contacting surface on an outer end thereof.

Each of these string clamping members is configured to slidably fit on to the main bar body, and each of the string clamping members has a central slot formed laterally therethrough, including an upper portion configured to allow the string clamping member to be slidably fitted on to the clamping bar's main bar body. The central slot also includes a lower portion which is configured to slidably receive a portion of an elongated cushion member therethrough, where a single cushion member extends through all of the string clamping members. The upper and lower portions may be the same with or different widths. Optionally, the upper portion, which receives the main bar body, may be narrower than the lower portion which receives the cushion member.

The cushion member and the string clamping members may be configured so that the string clamping members are retained on the main bar body by an interference fit between the cushion member, the main bar body and the string clamping members.

The present invention also provides methods of using the inventive capo.

Additional embodiments of the present invention are also contemplated, and are described herein in the detailed description section.

For a better understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 7B also includes an enlarged inset of a circled portion of the drawing.

FIG. 11A is a perspective view of a single string clamping member which is a component part of the capo of FIG. 8.

FIG. 11B is a side plan view of the string clamping member of FIG. 11A; and.

FIG. 11C is an end plan view of the string clamping member of FIG. 11A.

DETAILED DESCRIPTION OF ILLUSTRATIVE EMBODIMENTS

Figure 1:
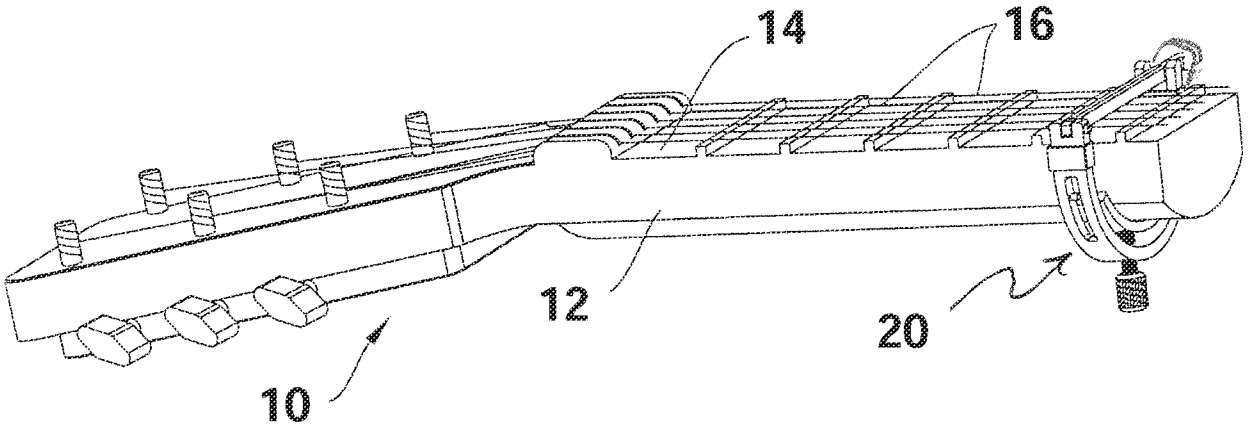
FIG. 1 is an environmental perspective view, partially cut away, of a guitar neck having a capo installed thereon according to a first illustrative embodiment of the present invention.

Descriptions will be provided below of selected illustrative embodiments of the present invention on a basis of examples of the invention, supported by and shown in the accompanying drawings. It should be understood that only structures considered necessary for clarifying the present invention are described herein. Other conventional structures, and those of ancillary and auxiliary components of the system, will be known and understood by those skilled in the art.

Throughout the present specification, relative positional terms like 'upper', 'lower', 'front', 'rear', 'top', 'bottom', 'horizontal', 'vertical', and the like are used to refer to the orientation of the capo apparatus and components as shown in the drawings. These terms are used in an illustrative sense to describe the depicted embodiments, and are not meant to limit the invention. It will be understood that the depicted apparatus and components thereof may be placed at orientations different from that shown in the drawings, such as inverted 180 degrees or transverse to that shown, and in such a case, the above-identified relative positional terms will no longer be accurate.

While the drawings and description herein describe the capo as used with a stringed instrument such as a guitar, it should be understood that the stringed musical instrument does not form part of the invention, per se, but instead, the stringed instrument constitutes a workpiece on which the capo hereof is applied.

First Embodiment

Referring now to the drawings, FIG. 1 generally shows a capo 20 according to a first illustrative embodiment of the present invention, in operation on a fretboard 14 situated on one side of a neck 12 of a stringed instrument 10, and compressing portions of the strings 16.

Figure 2:
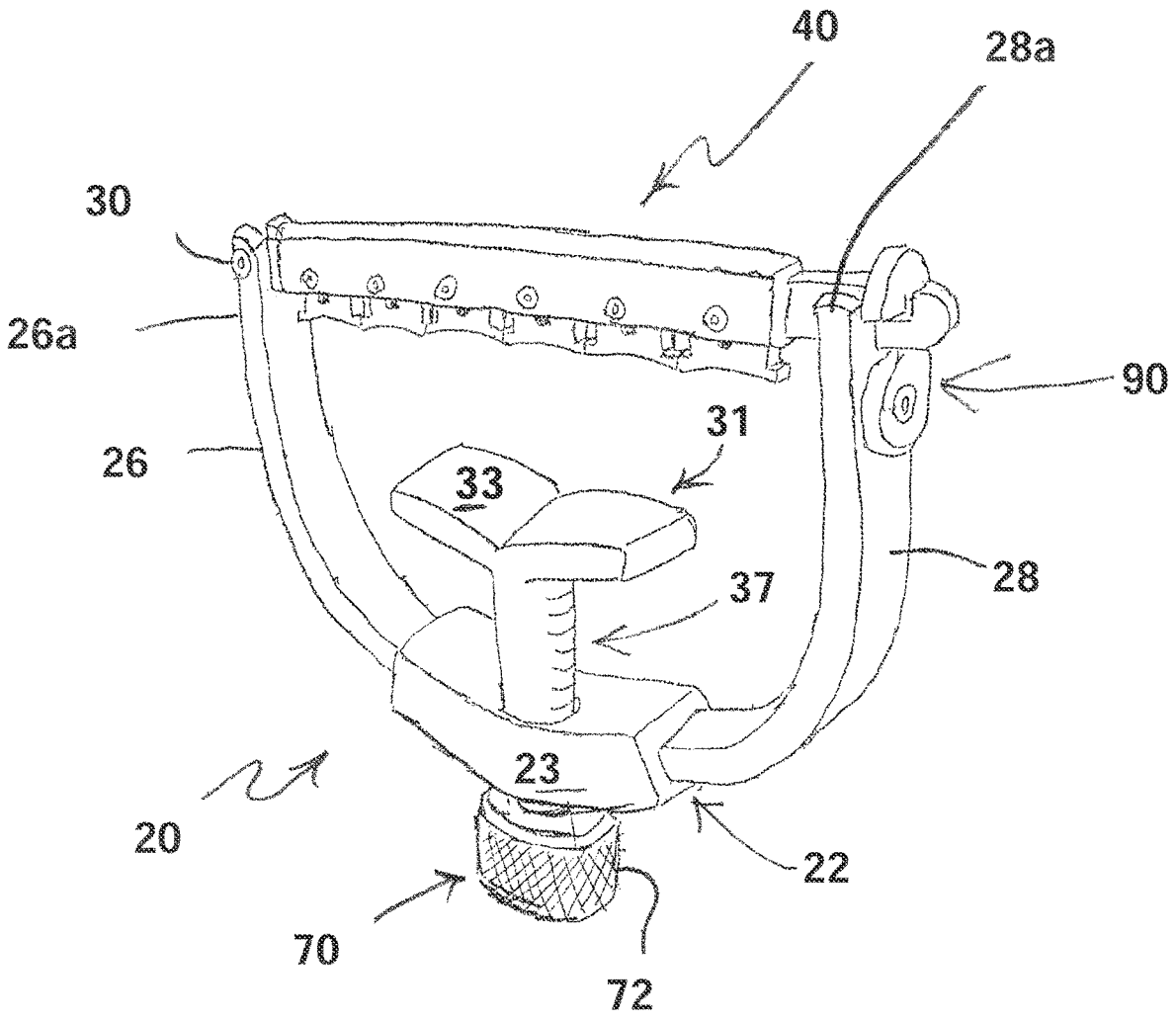
FIG. 2 is a perspective view of the capo of FIG. 1, shown separately from the guitar.
Figure 3A:
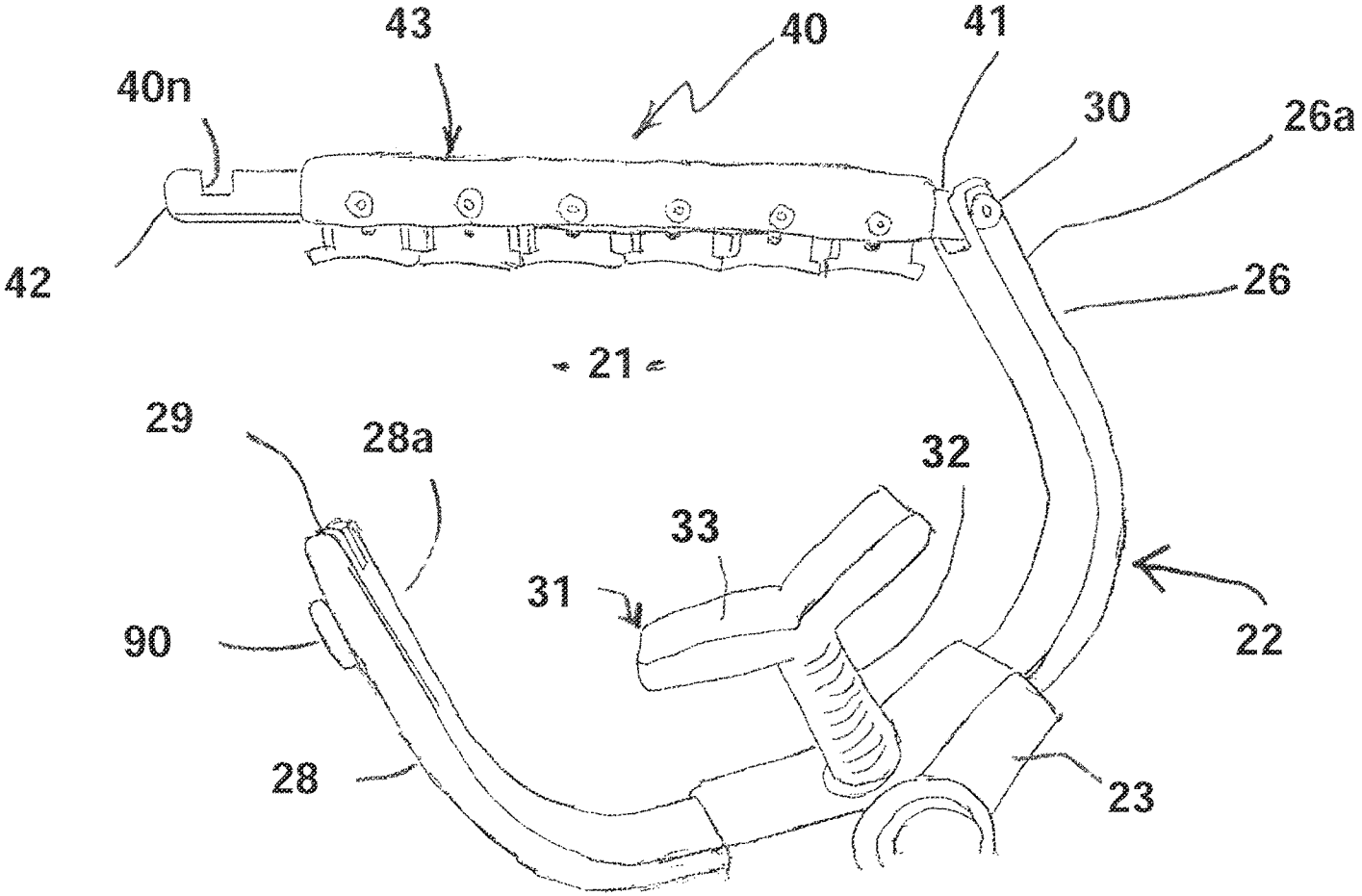
FIG. 3A is a detail perspective view of the capo of FIGS. 1-2, shown in a partially open position.

Referring also to FIGS. 2 and 3A, the capo 20 includes three main parts, a yoke 22, a clamping bar assembly 40 pivotally attached to the yoke, and an adjustment mechanism 37 which is adjustably connected to the yoke. The adjustment mechanism 37 includes a saddle member 31 which is configured to contact an underside of the instrument's neck 12.

The yoke 22 is a substantially U-shaped member, as shown, including a central support member 23, as well as first and second yoke branches 26, 28 respectively attached to opposite sides of the central support member 23. The clamping bar assembly 40 is pivotally connected to an outer end portion 26*a* of the first yoke branch 26.

The adjustment mechanism 37 includes the saddle member 31, having a central shaft 32 which fits through a hollow bore formed in the central support member 23 of the yoke 22. The adjustment mechanism 37 also includes an adjustment member 70, which may be rotatably attached to the saddle member 31 in a manner so as to allow linear movement of the saddle member in relation to the central support member 23 of the yoke 22. The adjustment member 70 may include a thumbscrew or handle member 72 as shown.

The adjustment member 70 is adjustably connected to the central support member 23 of the yoke 22, as will be further described herein. A number of different configurations may be used for structure and operation of the yoke and adjustment member, as described in U.S. Pat. Nos. 7,973,227, 10,810,975 and 11,138,958, the entire disclosures of which are incorporated by reference herein.

One such modified configuration of the adjustment member, in which the central section of the yoke has a rectangular passage formed therethrough to receive and house a cylindrical adjustment nut, is shown in FIGS. 7A-7E of the drawings.

As can be seen from FIG. 1, when the capo 20 is installed on an instrument 10, the clamping bar assembly 40 extends transversely across the strings 16 of the fretboard 14. When the capo 20 applies a clamping force onto the strings 16, they are forced against the fretboard, thereby effectively changing the vibration length of the strings and changing the effective key of the instrument.

The compressive force of the clamping bar assembly 40, pressing onto the strings 16, is reinforced by a seat portion 33 of the saddle member 31 being squeezed against the back of the neck portion 12 of the instrument. The position of this saddle member 31 is adjusted through operation of the adjustment member 70, which is adjusted to cause the linked saddle member 31 to move with respect to the yoke 22, until the saddle member 31 and the clamping bar assembly 40 cooperate to clamp the instrument neck therebetween, and apply a sufficient compressive force to the strings.

Further details of each of the structural components of the capo 20 according to the first embodiment of the invention will be described below.

FIG. 2 is a perspective view of the capo of FIG. 1, shown separately from the guitar, and FIG. 3A is a detail perspective view of the capo of FIG. 2, shown in a partially open position.

In FIG. 2 of the drawings, the capo 20 according to the first embodiment of the present invention is shown separately from the instrument 10. As noted above, the generally U-shaped yoke 22 includes the central support member 23 and the first and second yoke branches 26, 28 extending outwardly from opposed sides of the central support member.

The clamping bar assembly 40 is pivotally attached to an upper end 26*a* of the first yoke branch 26 by a pivot connection 30. As shown in FIG. 3A, a free end 42 of the clamping bar assembly 40, opposite the pivot connection, has an open engagement notch 40*n* formed therein, and is selectively attachable to the second yoke branch 28 by a latching clip 90, as will be further described herein.

The yoke 22 may be constructed of stainless steel, and is configured and dimensioned to generally fit about the neck portion of a stringed musical instrument 10 such a guitar, as shown in FIG. 1. The yoke 22 is formed in an arcuate curvilinear U-shape, which is modified to have locally linear segments at the central support member 23 and adjacent each of the respective outer end portions 26*a* and 28*a* of the first and second yoke branches 26 and 28, respectively.

The yoke 22 includes the first yoke branch 26 extending outwardly on a first side of the central support member 23, and a second (free) yoke branch 28 extending outwardly on the other side of the central support member.

Figure 3B:
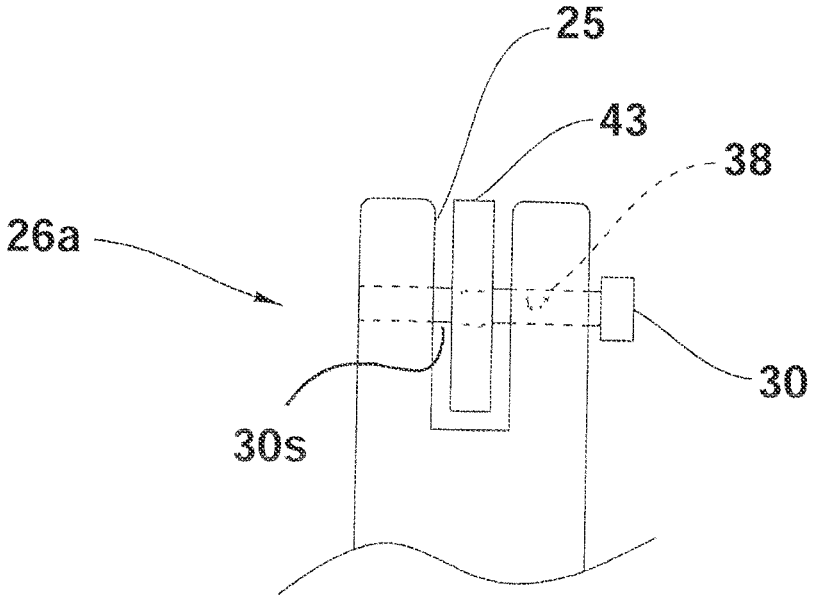
FIG. 3B is a detail view of one end portion of a yoke portion of the capo of FIGS. 1-2.

As shown in the detail view of FIG. 3B, the first yoke branch 26 includes a first yoke branch end 26*a* having a notch 25 formed therein, and also having a hollow bore 38 formed therein to receive a cylindrical shaft 30*s* of the pivot member 30, so that a main bar body 43 of the clamping bar assembly 40 may be pivotally connected to the first yoke branch 26.

Clamping Bar Assembly

Figure 4A:
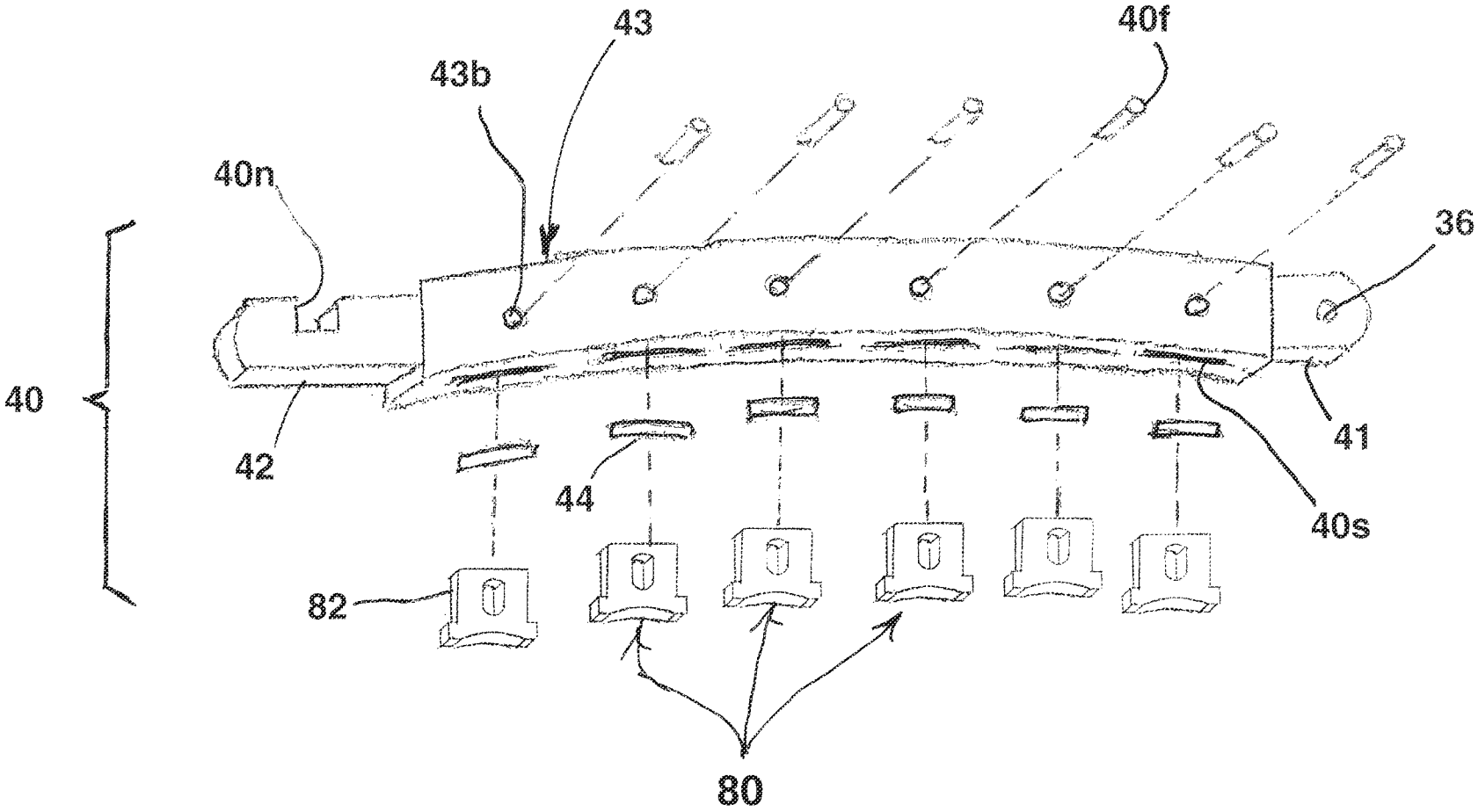
FIG. 4A is an exploded perspective view of a clamping bar assembly, which is a component of the capo of FIGS. 1-3B.

Referring now to FIG. 4A, in the capo according to this first embodiment of the invention, the clamping bar assembly's main bar body 43 has a first end 41 with a hole 36 formed therethrough to receive the shaft 30*s* of the pivot member 30. With the main bar body 43 aligned with the yoke 22, the shaft 30*s* (FIG. 3B) of the pivot member 30 is inserted into and through the respective holes 36, 38 to pivotally attach the main bar body 43 of the clamping bar assembly 40 to the yoke 22. The pivot member 30 may be a rivet, screw or other fastener known in the art, creating a relatively permanent pivot connection between the yoke 22 and the clamping bar assembly 40.

The main bar body 43 of the clamping bar assembly 40 also has a second end 42 opposite the first end, the second end being operatively engagable with a nesting notch 29 (FIG. 3A) formed in the upper end 28*a* of the second yoke branch 28, to allow a user to temporarily and releasably lock the clamping bar assembly 40 in place on the yoke 22. The second end 42 of the main bar body 43 may also be referred to as the free end.

The clamping bar assembly 40 is pivotally movable between a closed position, shown in FIG. 2 of the drawings, and an open position shown in FIG. 3A, with the clamping bar assembly rotated on the pivot member 30 away from the second yoke branch 28. In the open position of the clamping bar assembly 40, the second (free) end 42 thereof moves away from the yoke's second branch portion 28, and a space 21 between the branches 26, 28 of the yoke is uncovered to permit placement of the capo on an instrument's neck 12.

Figure 4B:
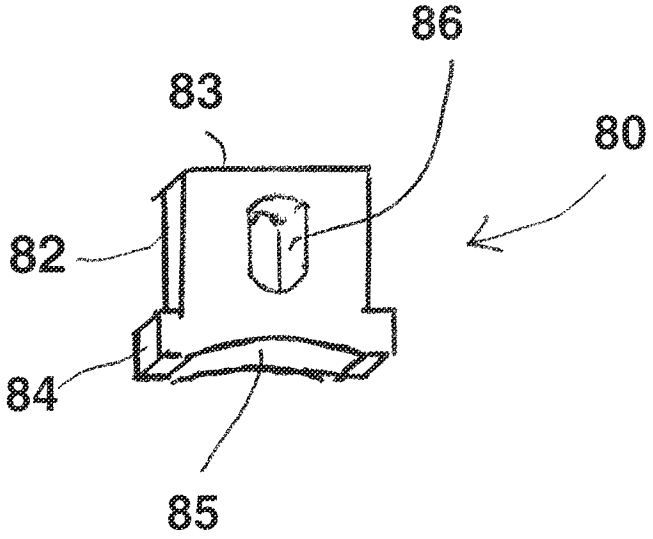
FIG. 4B is a perspective view of a string clamp insert which is a component part of the clamping bar assembly of FIG. 4A.
Figure 5A:
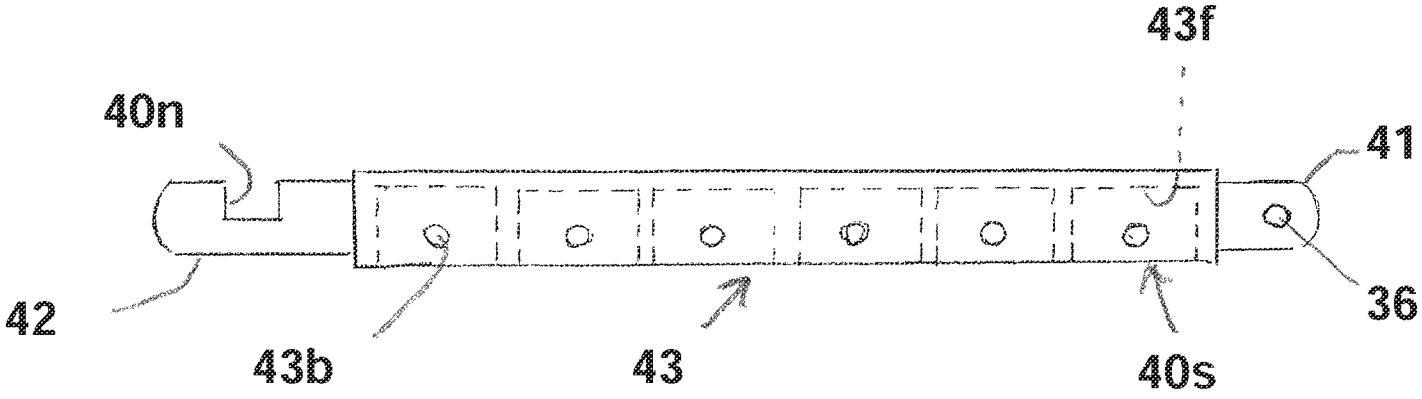
FIG. 5A is a side plan view of a main bar member which is a sub-component of the clamping bar assembly of FIG. 4A, with a number of hollow sockets shown in phantom.
Figure 5B:
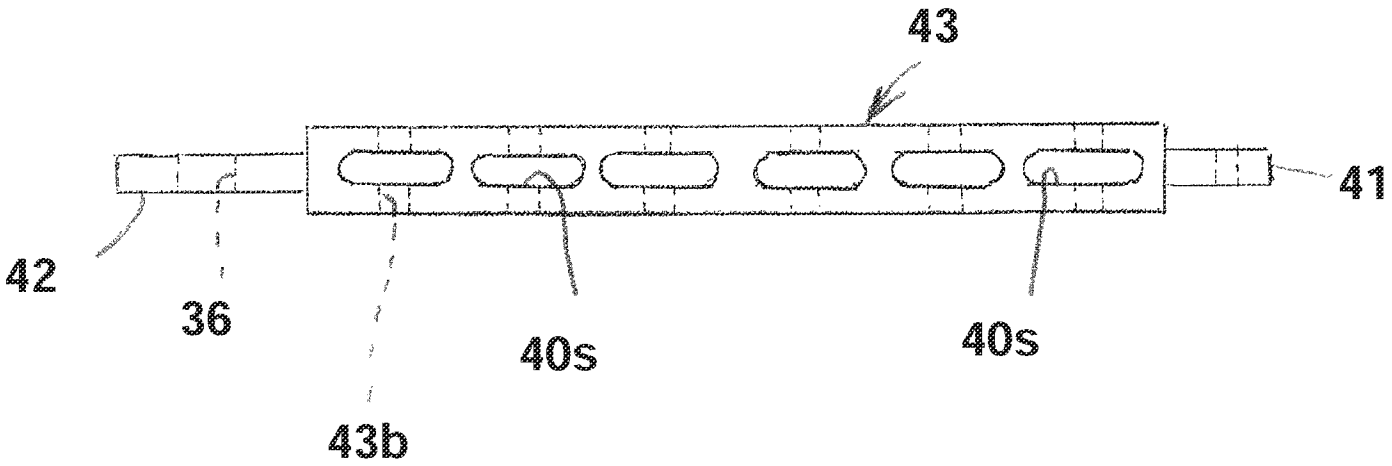
FIG. 5B is a bottom plan view of the main bar member of FIG. 5A.

Referring also to FIGS. 5A, and 5B, it will be seen that in this first illustrative embodiment of the capo according to the present invention, the main bar body 43 of the capo's clamping bar assembly 40 has a plurality of hollow sockets 40*s* formed therein and extending substantially parallel to one another. Each of these sockets 40*s* has a floor 43*f* (FIG. 5A), and is configured to receive a base portion 82 of a string clamp insert 80 (FIGS. 4A, 4B) therein. The main bar body 43 further has a plurality of hollow mounting bores 43*b* formed therethrough, each of the mounting bores transversely intersecting a longitudinal axis of a respective one of the sockets 40*s*, as shown.

As shown in FIG. 4, the capo's clamping bar assembly 40 further includes a plurality of resilient cushion members 44, in a number corresponding to the plurality of sockets 40*s*. Each of the sockets receives a cushion member 44 therein proximate the socket floor 43*f*. These cushion members 44 may be formed of rubber or a suitable elastomer. Alternatively, the cushion members 44 may be springs such as, for example, bow-shaped leaf springs (not shown).

The capo's clamping bar assembly 40 further includes a plurality of substantially identical string clamp inserts 80, which provide string clamping members. The string clamp inserts 80 are formed from a strong plastic material such as polyether ether ketone (PEEK), or polyetherimide, which is sold under the brand Ultem®.

As seen best in FIG. 4B, each of the inserts 80 bay be formed in an inverted T-shape having a relatively narrow base portion 82 with a cushion-contacting end 83. The base portion 82 of each of these string clamp inserts 80 is configured to fit slidably inside a respective one of the sockets 40*s* of the main bar body 43, with one of the resilient cushion members 44 disposed between the insert and the floor 43*f* of the socket.

Each string clamp insert 80 also has a widened string-contacting portion 84 which provides a string-contacting end opposite the cushion-contacting end 83. The outer surface of the string-contacting portion 84 may be formed as an arcuate concave string-contacting surface 85, which helps to align a corresponding one of the strings 16 to a central portion of the insert 80 during use of the capo 20.

Figure 7A:
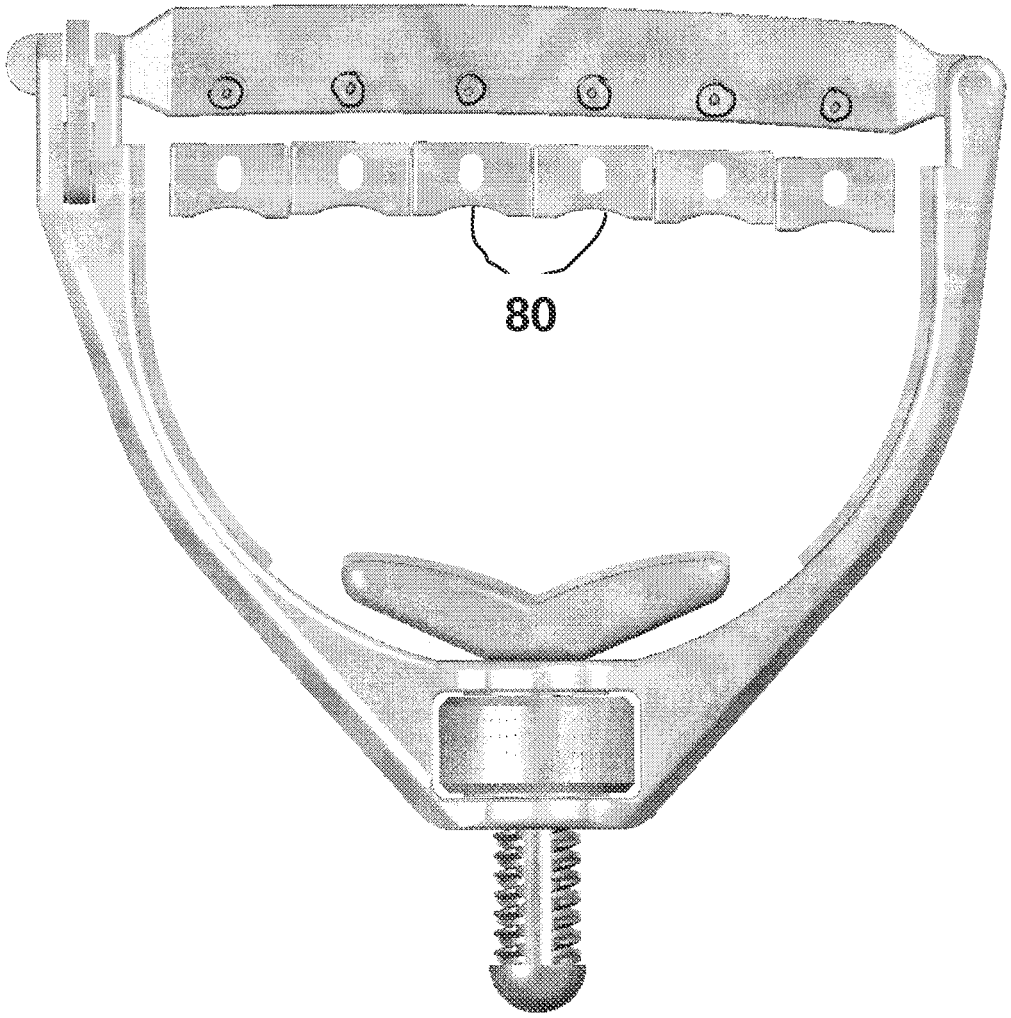
FIG. 7A is a side plan view of another capo according to the first embodiment, having a modified yoke and latch assembly, and also showing string clamping members separate from a main bar member of a clamping bar assembly.

If desired, the string clamp inserts 80 may be made in a modified rectangular shape, where the string-contacting portion has the same width as the base portion, as shown in FIG. 7A.

Each of the string clamp inserts 80 also has a hollow central slot 86 formed therethrough and extending vertically therein, as shown, to receive a cylindrical shaft of another fastener 40*f* (FIG. 4A) therethrough. During use of the capo 20, the slot 86 permits the string clamp insert 80 to slidably move in relation to the main bar body 43 by a limited distance, separate from and substantially independently of the other string clamp inserts, while remaining operatively attached to the main bar body.

As best seen in FIG. 4A, the capo's clamping bar assembly 40 further includes a plurality of fasteners 40*f*, which may be roll pins, rivets, or other suitable fasteners known in the art. Each of the fasteners 40*f* has a cylindrical shaft which passes through one of the hollow bores 43*b* of the main bar body 43, and also through the slot 86 of a corresponding one of the spring clamp inserts 80, to slidably retain the spring clamp insert in a respective one of the sockets 40*s* of the main bar body 43.

Latch Structure

The capo according to the first illustrative embodiment also includes a latch structure, including a locking clip 90 which is pivotally attached to the second branch end 28*a* of the yoke, for selectively and releasably engaging the second end of the clamping bar to temporarily and releasably lock the second end of the clamping bar to the second branch end.

Figure 6B:
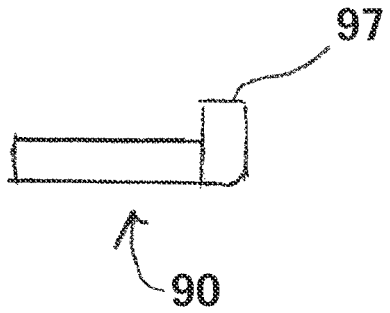
FIG. 6B is a top plan view of the locking clip of FIG. 6A.
Figure 6A:
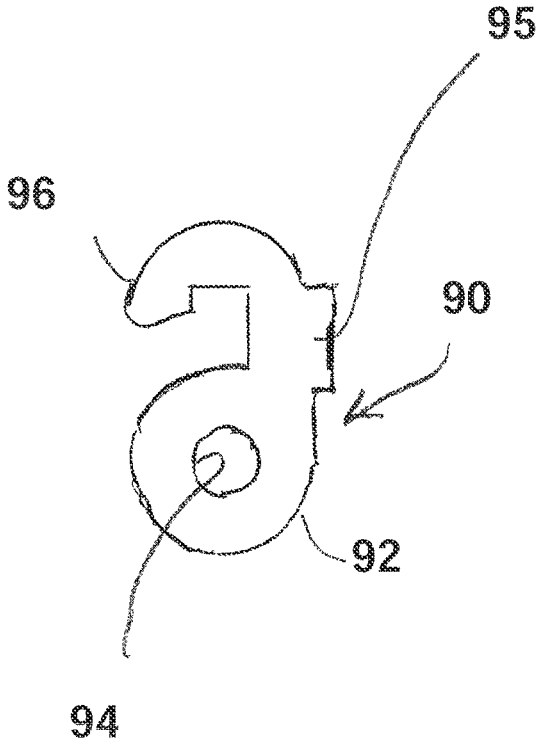
FIG. 6A is a side plan view of a locking clip which is another component of the capo of FIGS. 1-3B.

Referring now to FIGS. 6A-6B together with FIG. 2, the locking clip 90 is formed in a shape resembling a mirror image of the number 6, having a circular base 92 at a lower end thereof with a mounting hole 94 formed therethrough, a central part 95 extending upwardly from one side of the circular base, and a curved latching finger 96 integrally attached to the upper end of the central part 95. The latching finger 96 is selectively engagable in the notch 40*n* (FIG. 3A) formed in the second end 42 of the main bar body 43.

The central part 95 of the locking clip 90 may have a tab 97 extending outwardly thereon, and this tab 97 may be bent approximately 90 degrees from the rest of the latching clip, as shown, to provide a surface configured for a user to grasp when moving the clip into or out of engagement with the second end 42 of the main bar body 43.

Modified Embodiments

A first modified embodiment of the capo 20 is shown in FIG. 7A, and includes an adjustment member in which the central section of the yoke has a rectangular passage formed therethrough to receive and house a cylindrical adjustment nut. This modified embodiment also uses inserts 80 which have a constant width, and places the locking clip 90 inside of another notch formed perpendicular to the nesting notch 29 inside of the second end of the yoke.

Figure 7B:
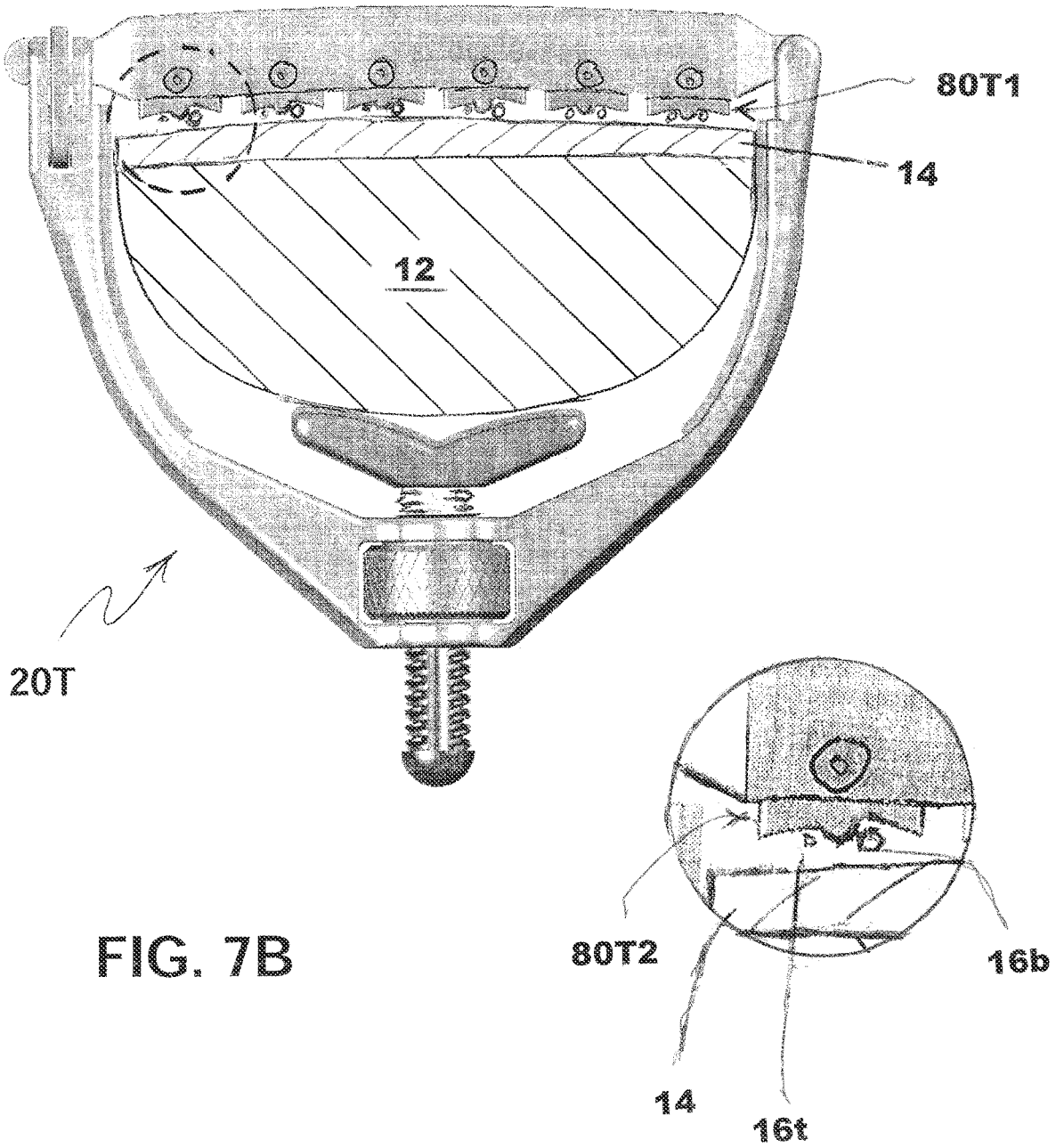
FIG. 7B is a side plan view of a yet another capo 20T according to a modified version of the first embodiment, also showing a cross-sectional view of an instrument which has the capo mounted thereon, the capo having string clamping members modified to fit on a 12-string guitar.
Figure 7C:
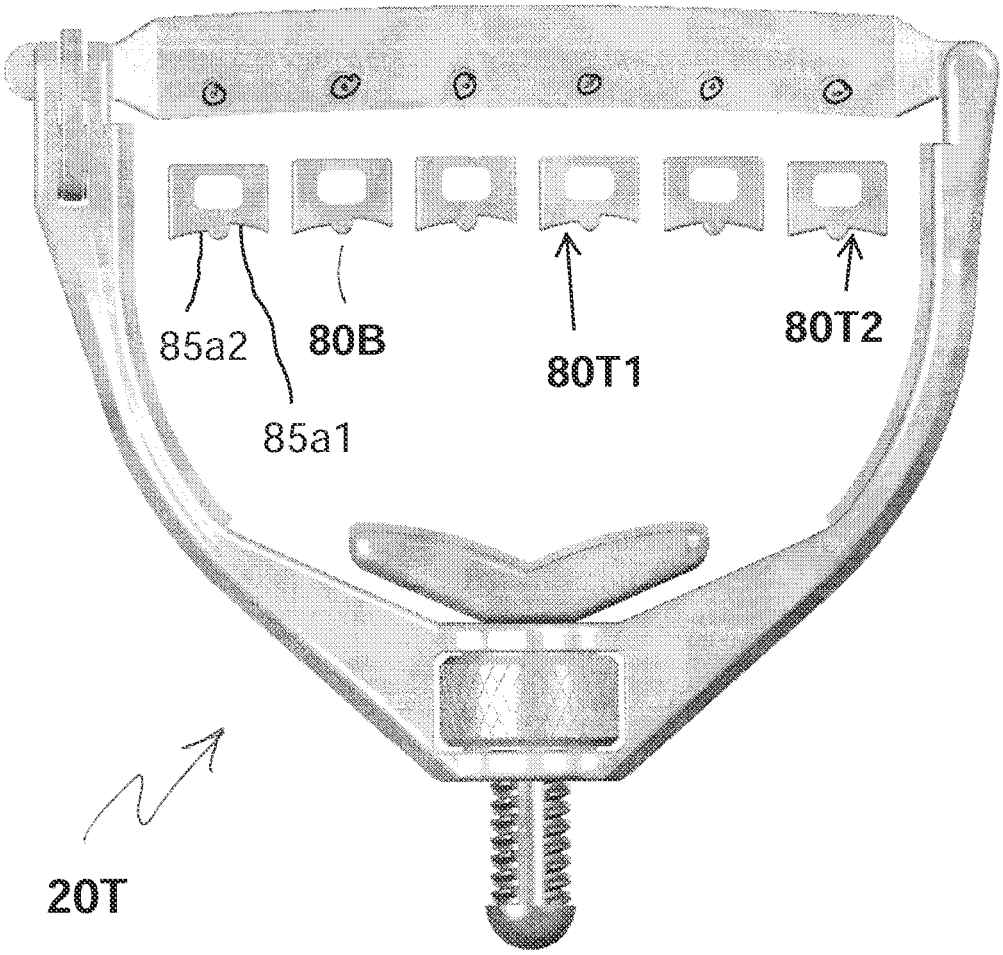
FIG. 7C is a side plan view of the capo of FIG. 7B, also showing the string clamping members separate from a clamping bar assembly.
Figure 7D:
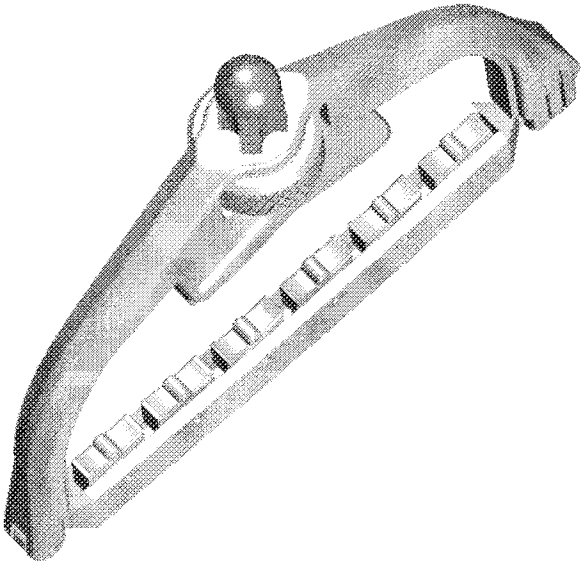
FIG. 7D is a perspective view of the capo of FIGS. 7B-7C, taken from a vantage point below and to the side of the capo.

A second modified embodiment of a capo 20T is shown in FIG. 7B-7D, and has the same modifications discussed above in connection with the first modified embodiment. In addition, this modified capo 20T is specially designed for use with a 12-string guitar having six pairs of string sets, where each string set includes two closely-spaced strings such as those shown at 16*t* and 16*b*, and for this reason, two different types of specialized string clamp inserts 80T1, 80T2 may be used. This Each of the string clamp inserts 80T1, 80T2 may be modified so that the string-contacting surface thereof is provided with an integrally formed central spacer boss 80B (FIG. 7C) extending outwardly thereon from a central portion of the string-contacting surface 85. During use of the capo of FIGS. 7B-7D in a clamped position on a twelve-string guitar, this spacer boss 80B keeps the two strings of its corresponding string pair properly spaced away from each other.

The lowermost (in tone) four pairs of strings on a twelve-string guitar include both a bass string such as 16*b*, having a relatively large diameter, and a treble string such as 16*t*, which has a smaller diameter and is tuned an octave higher than the bass string. As seen in the enlarged insert of FIG. 7B, the treble string 16*t* has a much smaller diameter than the bass string 16*b*. For this reason, the inserts 80T2 used for the lowermost four string sets have a deeper recess 85*a*1 (FIG. 7C) on a first side of the insert that contacts the bass string 16*b* of the pair, and a shallower recess 85*a*2 on a second side of the insert that contacts the treble string 16*t* of the pair, as shown.

FIG. 7D is a perspective view of the capo of FIGS. 7B-7C, taken from a vantage point below and to the side of the capo.

Figure 7E:
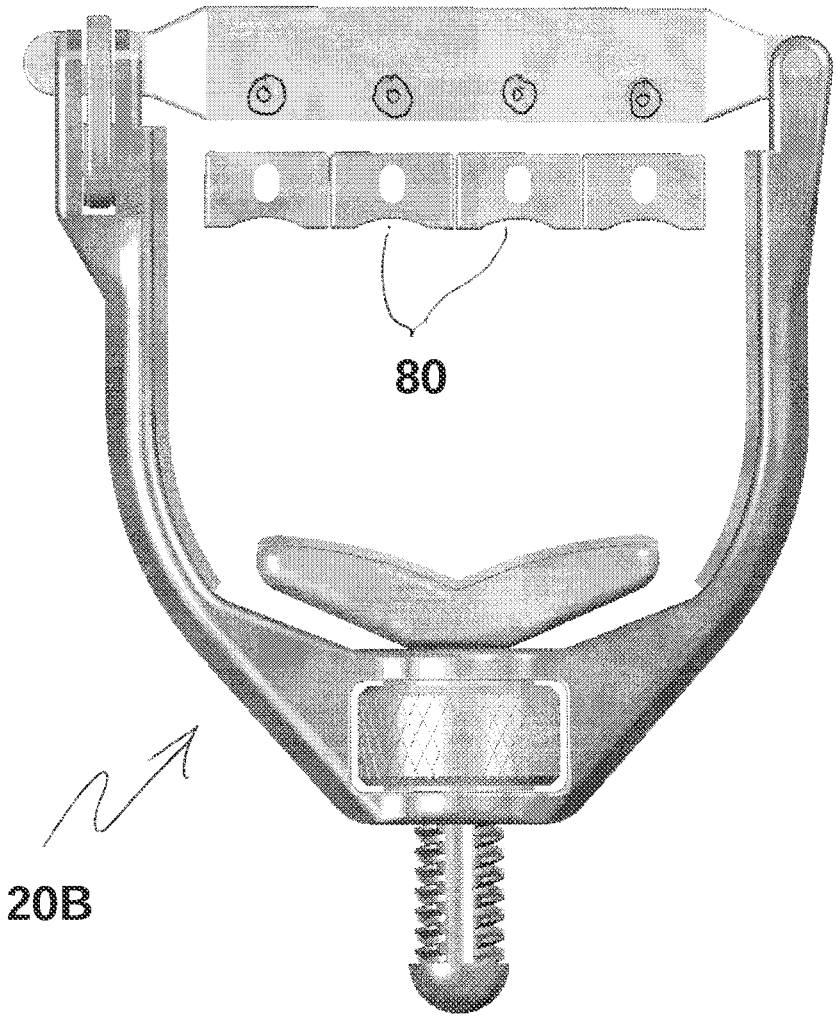
FIG. 7E is a side plan view of another capo according to the first embodiment hereof, configured to fit across four strings of a five-string banjo and having a modified yoke and latch assembly, also showing string clamping members separate from a clamping bar assembly.

FIG. 7E is a side plan view of another modified capo 20B according to the first embodiment of the present invention. This capo 20B has the same modifications discussed above in connection with the first modified embodiment In addition, this modified capo 20B only four string clamping members 80, and is configured to fit across four strings of a five-string banjo. FIG. 7E shows the string clamping members 80 separate from a main clamping bar of the clamping bar assembly.

Capo Operation

During installation of the capo 20 on an instrument 10, the clamping bar assembly 40 is placed extending transversely across the strings 16 of the fretboard 14, and is engaged with the second (free) end 28*a* of the yoke 22 by placing the second (free) end 42 of the main bar body 43 into the nesting notch 29 of the yoke, and then engaging the latching finger 96 of the latching clip 90 in the notch 40*n* of the main bar body 43.

The adjustment member 70 can then be selectively rotated by manually turning the handle portion 72 to make a tightening adjustment. The position of the saddle member is adjusted through operation of the adjustment member 70, which is adjusted to cause the saddle member 31 to slide axially in relation to the yoke 22 until the clamping bar assembly 40 applies a desired compressive force upon the strings.

Each of the string clamp inserts 80 is substantially independent of the other string clamp inserts 80, and when the capo is clamped on to a musical instrument as shown in FIG. 1, each of the string clamp inserts 80 is individually movable based on an adjustment between the tension applied to the string-contacting surface 85 by the corresponding string or strings, and an opposite pressure applied to the cushion-contacting end 83 of the insert 80 by the corresponding cushion member 44, which is under compression.

Second Embodiment

Figure 8:
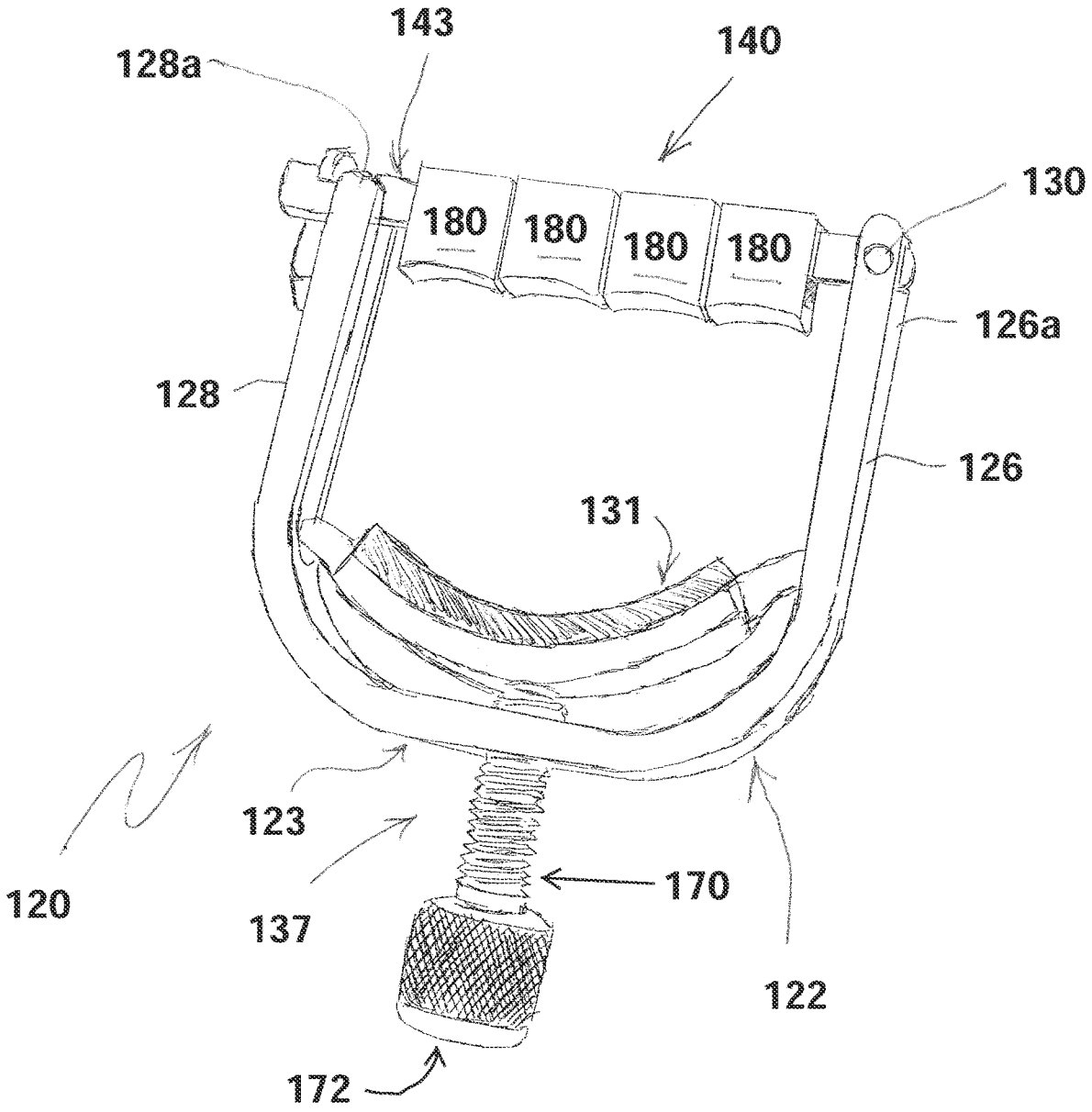
FIG. 8 is a perspective view of another capo according to a second embodiment of the present invention.

Referring now to FIG. 8 of the drawings, another capo 120 according to a second illustrative embodiment of the present invention is shown separately from the instrument 10. The capo shown in FIG. 8 is also configured to fit on a banjo (not shown), and to clamp across four strings of the banjo. Accordingly, this capo only has for string clamp members 180 on its clamping bar assembly 140.

This capo 120 also includes three main parts, a yoke 122, a clamping bar assembly 140 pivotally attached to one side of the yoke, and an adjustment mechanism 137 including a saddle member 131 which is configured to contact an underside of a banjo neck (not shown).

The primary difference between the capos 20, 120 according to the first and second embodiments is that in the second embodiment, the clamping bar assembly 140 is quite different from the clamping bar assembly 40 of the first embodiment.

In a manner similar to that described above in connection with the first embodiment, the generally U-shaped yoke 122 includes a central support member 123 and the first and second yoke branches 126, 128 extending outwardly from opposed sides of the central support member. As noted above in connection with the first embodiment, a number of different configurations may be used for structure and operation of the yoke and adjustment member as described in U.S. Pat. No. 7,973,227 10,810,975 and 11,138,958, the entire disclosures of which are incorporated by reference herein.

Figure 9:
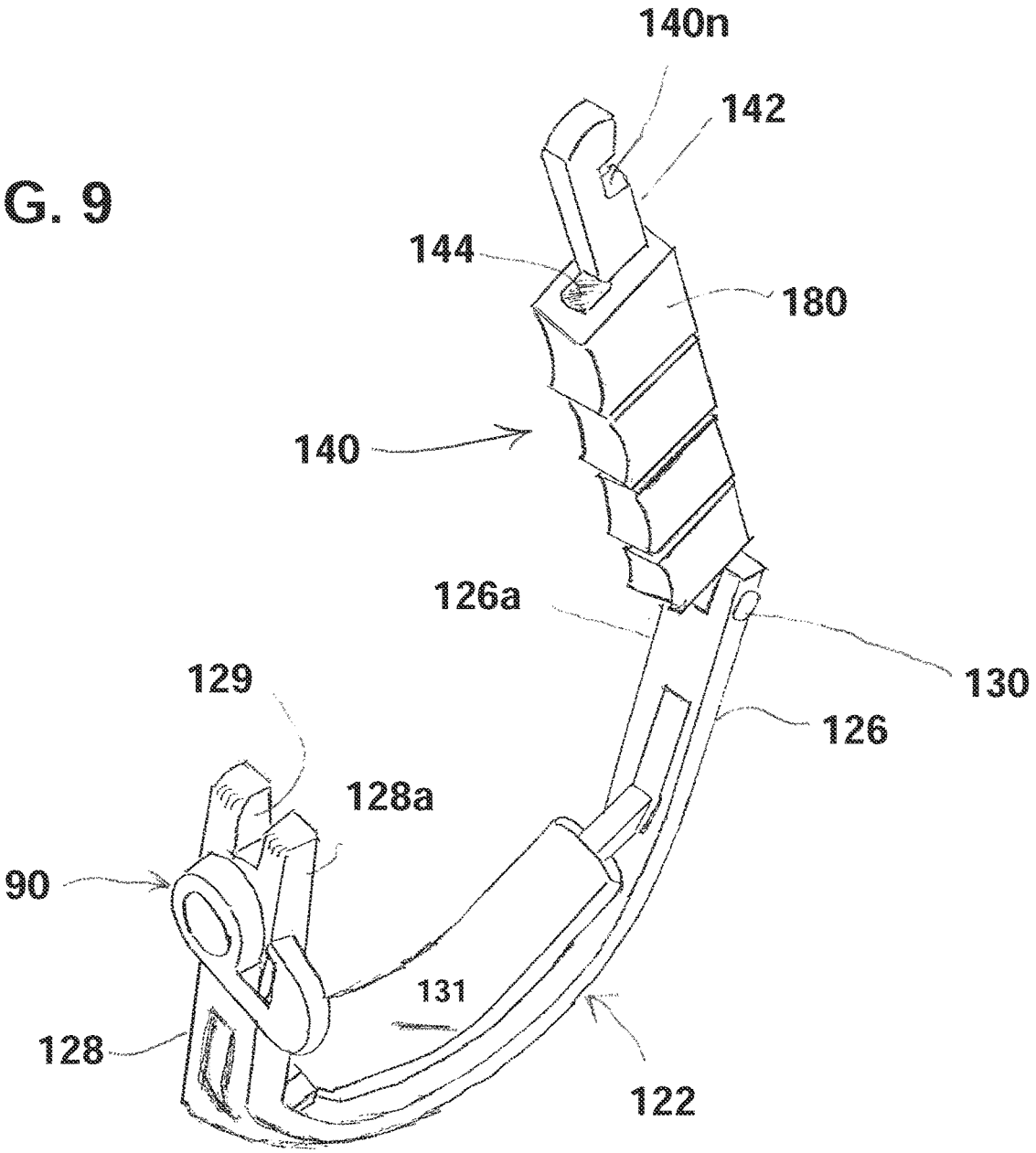
FIG. 9 is a detail perspective view of the capo of FIG. 8, shown in an open position and with an adjustment member at the lower end omitted from the drawing for purposes of illustration.

The clamping bar assembly 140 is pivotally attached to the first yoke branch 126 by a pivot connection 130. As shown in FIG. 9, a free end 142 of the clamping bar assembly 140, opposite the pivot connection, has an open notch 140*n* formed therein, and is attachable to the second yoke branch 128 by a latching clip 90, as described above in connection with the first embodiment.

The yoke 122 may be constructed of stainless steel, and is configured and dimensioned to generally fit about the neck portion of a standard stringed musical instrument such a banjo (not shown). The yoke 122 is formed in an arcuate curvilinear U-shape, which is modified to have locally linear segments at the central support member 123 and adjacent each of the respective outer end portions 126*a* and 128*a* of the first and second yoke branches 126 and 128, respectively.

The yoke 122 includes the first yoke branch 126 extending outwardly on one side of the central support member 123, and a second (free) yoke branch 128 extending outwardly on the other side of the central support member. As shown in the detail views of FIGS. 9-10, the first yoke branch 126 includes a first yoke branch end 126*a* having a notch 125 formed therein, and also having a hollow bore formed therein to receive a cylindrical shaft of the pivot member 130 therein, so that a main bar body 143 of the clamping bar assembly 140 may be pivotally connected to the first yoke branch 126. This arrangement is similar to that of the yoke 22 according to the first embodiment, as previously described herein.

Figure 10:
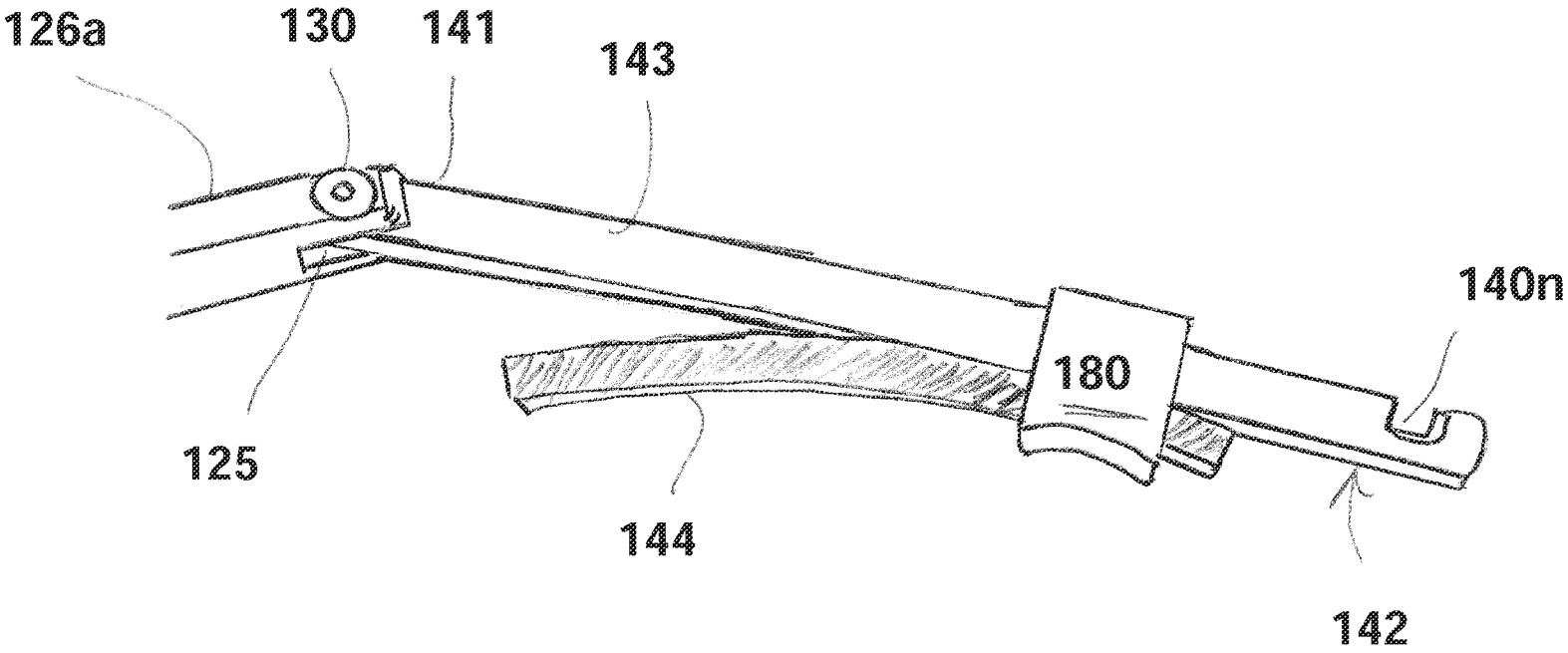
FIG. 10 is a detail perspective view of a main bar body, which is a component part of the capo of FIG. 8, having a single string clamping member and a cushion member attached thereto.

Referring also to FIG. 10, in the capo 120 according to the second illustrative embodiment of the present invention, the main bar body 143 of the clamping bar assembly 140 is a generally solid metal bar having a rectangular cross section. In the capo 120 according to this second embodiment of the invention, the clamping bar's main bar body 143 has a first end 141 with a hole formed therethrough to receive a shaft of the pivot member 130.

The main bar body 143 of the clamping bar assembly 140 also has a second end 142 opposite the first end, the second end being operatively engagable with a nesting notch 129 formed in the upper end 128*a* of the second yoke branch 128, to allow a user to temporarily and releasably lock the clamping bar assembly 140 in place on the yoke 122. The second end 142 of the main bar body 143 may also be referred to as the free end, because it is not permanently connected to the yoke 122.

With the main bar body 143 aligned with the yoke 122, the shaft of the pivot member 130 (similar to that shown at 30*s* in FIG. 3B) is inserted into the respective holes to pivotally attach the clamping bar assembly 140 to the yoke 122. The pivot member 130 may be a rivet, screw or other fastener known in the art, creating a relatively permanent pivot connection between the yoke 122 and the clamping bar assembly 140.

The clamping bar assembly 140 is pivotally movable between a closed position, shown in FIG. 8 of the drawings, and an open position shown in FIG. 9, with the clamping bar rotated on the pivot member 130 away from the second yoke branch 128. In the open position of the clamping bar assembly 140, the second end 142 thereof extends away from the yoke's second branch portion 128, and a space between the branches 126, 128 of the yoke 122 is uncovered to permit placement of the capo on an instrument's neck.

Referring also to FIGS. 11A-11C, it will be seen that in this second illustrative embodiment of the capo 120 according to the present invention, the clamping bar assembly 140 includes a plurality of individual string clamp members 180, each of the string clamp members being formed separately from and movable independently of adjacent string clamp members.

As seen best in FIGS. 11A-11C, each of the string clamp members 180 has a cushion-contacting portion 183 and a string-contacting portion 184 spaced away from the cushion-contacting portion. The string-contacting portion 184 includes an arcuate string-contacting surface 185.

Each of the string clamp members 180 has a hollow passage 186 formed therethrough to permit the string clamp member to receive both the clamping bar's main bar body 143 and an elongated cushion member 144 therethrough, in such a manner as to permit the string clamp members 180 be slidably movable on the main bar body 143. The hollow passage 186 includes both a first portion 187 configured to receive the main bar body 143, and a second portion 188 configured to receive part of the elongated cushion member 144. While these two portions 187, 188 of the hollow passage are shown to have different widths in FIGS. 11A and 11C, it is contemplated that they may have the same width without departing from the scope of the invention.

FIG. 10 illustrates a single string clamp member 180 disposed on the main bar body 143 during initial assembly of the capo 120, and clearly shows the elongated cushion member 144, which is shared between all of the string clamp members 180. As seen best in FIG. 10, the capo's clamping bar assembly 140 further includes the elongated resilient cushion member 144, which slidably fits through the second portion 186 of each of the individual string clamp members 180. This cushion member 144 may be formed of rubber or a suitable elastomer. Alternatively, the cushion member 144 may be replaced by a plurality of springs such as, for example, bow-shaped leaf springs, held in place in a manner which will be understood by those in the art.

Capo Operation

During installation of the capo 120 on an instrument (not shown), the clamping bar assembly 140 is placed extending transversely across the strings 16 of the fretboard 14, and is engaged with the free end 128*a* of the yoke 122. The adjustment member 170 can then be selectively rotated by manually turning the handle portion 172 to make a tightening adjustment. The position of the saddle member is adjusted through operation of the adjustment member 170, which is adjusted to cause the saddle member 131 to slide with respect to the yoke 122 until the clamping bar assembly 140 applies a desired compressive force upon the strings.

Each of the string clamp members 180 is made separate from the other string clamp members, and is movable substantially independently of the other string clamp members, to clamp its corresponding string or strings.

Method of Using the Capo

The capo 120 is used in a manner similar to that described above in connection with the capo 20 according to the first embodiment.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the present description, are intended to be within the scope and spirit of the present invention.

I claim:

1. A capo for use with a musical instrument having a neck including a fretboard and a plurality of strings extending parallel to one another above the fretboard, the capo comprising:

a substantially U-shaped yoke having a first branch and a second branch;

a clamping bar assembly pivotally attached to one of the branches of the yoke, the clamping bar assembly comprising:

a main bar body;

a plurality of separate string clamp members formed of a substantially rigid plastic material, the string clamp members being operatively attached to the main bar body; and at least one flexibly resilient cushion member provided between at least one of the string clamp members and the main bar body.

2. The capo of claim 1, wherein the string clamp members comprise at least one material selected from the group consisting of polyetherimide and polyether ether ketone.

3. The capo of claim 1, wherein the main bar body has a plurality of hollow sockets formed therein which are substantially parallel to one another, and wherein each of the sockets slidably receives a portion of one of said string clamp members therein.

4. The capo of claim 1, wherein each of the string clamp members has a hollow passage formed therein which slidably receives a portion of the main bar body therethrough.

5. The capo of claim 1, wherein each of the string clamp members has a string-contacting portion formed with an arcuate concave string-contacting surface.

6. The capo of claim 5, wherein the string-contacting surface of each of the string clamp members is provided with an integrally formed central spacer boss extending outwardly thereon at a central portion thereof.

7. A capo for use with a musical instrument having a neck including a fretboard and a plurality of strings extending parallel to one another above the fretboard, the capo comprising:

a substantially U-shaped yoke, the yoke comprising a central yoke body and first and second branches extending outwardly from opposite sides of the central yoke body, the central yoke body having a hollow bore formed therein, the first branch terminating at a first branch end, and the second branch terminating at a second branch end having a nesting notch formed therein;

a substantially Y-shaped saddle member adjustably connected to the central yoke body of the yoke, the saddle member comprising a central stem and a seat portion integrally attached to an end of the stem for placement contacting a portion of the neck opposite the fretboard; wherein the stem passes through the hollow bore of the yoke body, a clamping bar assembly comprising:

a main bar body having a first end and a second end, the first end of the main bar body being pivotally connected to the first branch end of the yoke, and the second end of the main bar body being operatively engagable with the nesting notch of the second branch;

a plurality of string clamp members formed from a substantially rigid plastic material, each of the string clamp members being separate from adjacent string clamp members, and at least one resilient cushion member disposed between the main bar body and at least one of the string clamp members; and the capo further comprising a latch structure attached to the second branch end of the yoke for releasably engaging the second end of the main bar body to temporarily and releasably lock the clamping bar assembly to the yoke.

8. The capo of claim 7, wherein the string clamp members comprise at least one material selected from the group consisting of polyetherimide and polyether ether ketone.

9. The capo of claim 7, wherein the main bar body has a plurality of hollow sockets formed therein which are substantially parallel to one another, and wherein each of the sockets slidably receives a portion of one of said string clamp members therein.

10. The capo of claim 7, wherein each of the string clamp members has a hollow passage formed therein which slidably receives a portion of the main bar body therethrough.

11. The capo of claim 7, wherein each of the string clamp members has a string-contacting portion formed with an arcuate concave string-contacting surface.

12. The capo of claim 7, wherein the string-contacting surface of each of the string clamp members is provided with an integrally formed central spacer boss extending outwardly thereon at a central portion thereof.

13. The capo of claim 7, wherein the latch structure comprises a closure clip pivotally attached to the second branch end of the yoke proximate the nesting notch, the closure clip having an opening formed therein, wherein the clamping bar has a latching notch at the second end thereof, and wherein the opening of the closure clip is temporarily and releasably engagable with the latching notch of the clamping bar.

14. A capo for a musical instrument having a fretboard with a plurality of strings, the capo comprising a yoke having a main yoke body, a first branch and a second branch, a clamping bar assembly pivotally attached to the yoke and comprising:

a main bar body having a first end and a second end, the first end of the main bar body being pivotally connected to the first branch end, and the second end of the main bar body being operatively engagable with the nesting notch of the second branch, wherein the main bar body has a plurality of hollow sockets formed therein and extending substantially parallel to one another, each of the sockets having a floor and configured to receive a string clamping insert, and wherein the main bar body further has a plurality of hollow bores formed therethrough, each of the bores intersecting a respective one of the sockets;

a plurality of string clamp inserts, each of the inserts having a cushion-contacting portion and a string-contacting portion opposite the cushion-contacting portion, each of the inserts configured to fit slidably inside a respective one of the sockets of the main bar body, each of the string clamping members having a central slot formed therethrough and configured to receive a cylindrical shaft of a fastener;

a plurality of resilient cushion members in a number corresponding to the plurality of sockets, wherein each of the sockets receives a cushion member therein proximate the socket floor; and a plurality of fasteners, with each of the fasteners comprising a cylindrical shaft which passes through one of the hollow bores of the main bar body and through the slot of one of the inserts to slidably retain said one of the inserts in a respective one of the sockets of the main bar body, and the capo further comprising a latch structure pivotally attached to the second branch end of the yoke for releasably engaging the second end of the main bar body to temporarily and releasably lock the clamping bar assembly to the yoke.

15. The capo of claim 14, wherein the string clamp inserts comprise at least one material selected from the group consisting of polyetherimide and polyether ether ketone.

16. The capo of claim 14, wherein the string-contacting portion of each of the string clamp inserts is formed with an arcuate concave string-contacting surface.

17. The capo of claim 16, wherein the string-contacting surface of each of the string clamp members is provided with an integrally formed central spacer boss extending outwardly thereon at a central portion thereof.

18. The capo of claim 14, wherein the latch structure comprises a closure clip pivotally attached to the second branch end of the yoke proximate the nesting notch, the closure clip having an opening formed therein, wherein the clamping bar has a latching notch at the second end thereof, and wherein the opening of the closure clip is temporarily and releasably engagable with the latching notch of the clamping bar.

* * * * *